US011247842B2

(12) United States Patent
Morad et al.

(10) Patent No.: US 11,247,842 B2
(45) Date of Patent: Feb. 15, 2022

(54) HANDS FREE DISPOSAL UNIT

(71) Applicant: TRANZONIC COMPANIES, Cleveland, OH (US)

(72) Inventors: Fred I. Morad, Toluca Lake, CA (US); Robert A. Acosta, Norwalk, CA (US)

(73) Assignee: TRANZONIC COMPANIES, Cleveland, OH (US)

( * ) Notice: Subject to any disclaimer, the term of this patent is extended or adjusted under 35 U.S.C. 154(b) by 210 days.

(21) Appl. No.: 16/664,030

(22) Filed: Oct. 25, 2019

(65) Prior Publication Data

US 2020/0130930 A1 Apr. 30, 2020

Related U.S. Application Data

(60) Provisional application No. 62/751,030, filed on Oct. 26, 2018.

(51) Int. Cl.
*B65F 1/16* (2006.01)
*B65F 1/06* (2006.01)

(52) U.S. Cl.
CPC ..... *B65F 1/1638* (2013.01); *B65F 1/062* (2013.01); *B65F 2210/168* (2013.01); *B65F 2240/164* (2013.01)

(58) Field of Classification Search
CPC .. B65F 1/1638; B65F 1/062; B65F 2210/168; B65F 2240/164
USPC ..... 220/211
See application file for complete search history.

(56) References Cited

U.S. PATENT DOCUMENTS

| | | | | |
|---|---|---|---|---|
| 4,155,584 | A * | 5/1979 | Pracchia | B65F 1/1615 294/68.1 |
| 4,655,391 | A * | 4/1987 | Granzow | E05B 39/04 232/43.1 |
| 10,597,228 | B1 * | 3/2020 | Yao | B65F 1/1646 |
| 2011/0220648 | A1 * | 9/2011 | Yang | B65F 1/1638 220/211 |
| 2013/0233857 | A1 * | 9/2013 | Yang | B65F 1/04 220/495.08 |
| 2017/0096299 | A1 * | 4/2017 | Yang | G10L 25/51 |
| 2018/0079592 | A1 * | 3/2018 | Wang | B65F 1/1646 |
| 2018/0229931 | A1 * | 8/2018 | Shek | B65F 1/1638 |
| 2019/0270586 | A1 * | 9/2019 | Lovingood | B65F 1/1638 |
| 2020/0115158 | A1 * | 4/2020 | Wang | B65F 1/1638 |
| 2021/0061558 | A1 * | 3/2021 | Shek | B65F 1/1638 |
| 2021/0163220 | A1 * | 6/2021 | Lin | B65F 1/1638 |

* cited by examiner

*Primary Examiner* — J. Gregory Pickett
*Assistant Examiner* — Niki M Eloshway
(74) *Attorney, Agent, or Firm* — Taft Stettinius & Hollister LLP; Ryan O. White; Daniel J. Krieger

(57) ABSTRACT

A hands free waste disposal unit for receiving disposed waste product. The hands free waste disposal unit includes a body defining a cavity configured to hold the disposed waste product and a lid having a closed position and an open position. The lid is rotatably coupled to the body. A control circuit is located in the lid, wherein the control circuit includes a sensor and a motor each coupled to a controller, wherein the controller is configured to receive an open signal from the sensor and to transmit a motor signal to the motor in response to the open signal to move the lid from the closed position to the open position. The controller is configured to execute program instructions stored in a memory to identify a period of time to move the lid from the open position to the closed position.

18 Claims, 6 Drawing Sheets

HANDS FREE DISPOSAL UNIT

CROSS-REFERENCE TO RELATED APPLICATION

This application claims priority to U.S. Provisional Application No. 62/751,030, filed Oct. 26, 2018 entitled "Hands Free Disposal Unit" the disclosure of which is hereby incorporated by reference in its entirety.

FIELD OF THE DISCLOSURE

The present invention relates to a disposal unit configured to receive waste products, and more particularly to a disposal unit for the hands free disposal of personal care product waste products.

BACKGROUND

Various types of products are used by women and men for their personal care. Such products require proper disposal once use to reduce or prevent illnesses or the spreading of germs and infections to other. In one example, paper towels used to dry hands are thrown away once used to prevent the spreading of germs. In other examples, product such as feminine hygiene products, such as tampons, sanitary pads, sanitary towels, panty liners, and bladder control pads, should be property disposed of once used. Proper disposal requires that an individual disposes the personal care products into a waste disposal unit which is emptied on a regular basis. Typically, the waste disposal unit must be physically engaged (touched) by an individual to make the disposal. Contact with the disposal unit, however, can lead to the spreading of invention and germs not only from the used products, but also from the individual who may have an infection.

What is needed therefore is waste disposal unit that does not require contact from the individual to dispose of the waste product.

SUMMARY

In one embodiment, there is provided a hands free waste disposal unit including a controller configured to open and close the waste disposal unit in response to physical movement of an individual or an article being moved by an individual. The hands free waste disposal unit includes a motor to open and close a lid of the unit without the need for any gear or gears being driven by the shaft of the motor. The present disclosure therefore provides a novel mechanism for opening and closing the disposal unit without the need to for a user to contact the unit when disposing of used personal hygiene products.

In another embodiment, there is provided a hands free waste disposal unit for receiving disposed waste product including a body defining a cavity configured to hold the disposed waste product and a lid. The lid includes a closed position and an open position wherein the lid is rotatably coupled to the body. A control circuit is located in the lid, wherein the control circuit includes a sensor and a motor each coupled to a controller. The controller is configured to receive an open signal from the sensor and to transmit a motor signal to the motor to move the lid from the closed position to the open position.

In a further embodiment, there is provided a hands free waste disposal unit for receiving disposed waste product. The disposal unit includes a body configured to hold the disposed waste product and a lid defining a cavity and a slot. The lid is rotatably coupled to the body and moves from a closed position to an open position. A sensor is configured to sense physical movement provided by a user. A motor is operatively connected to the sensor wherein the motor includes a shaft that rotates in response to the sensed physical movement. The motor moves the lid from a closed position to an open position. An arm is operatively connected to the shaft and to the body, wherein the arm moves through the slot when the lid moves from the closed position to the open position.

In still another embodiment, there is provided a method of operating a disposal unit having a control circuit. The method includes the steps of: sensing with a sensor a first physical movement provided by a user; moving the lid of the disposal unit from a closed position to an open position in response to the sensed first physical movement; sensing with the sensor a second physical movement provided by the user; and moving the lid of the disposal unit from the open position to the closed position in response to the sensed second physical moment, wherein the control circuit moves with the lid as the lid moves from the closed position to the open position and from the open position to the closed position.

BRIEF DESCRIPTION OF THE DRAWINGS

The accompanying figures, which are incorporated in and constitute a part of the specification, illustrate various example apparatuses, systems, and methods, and are used merely to illustrate various example embodiments.

DETAILED DESCRIPTION

Figure 2:
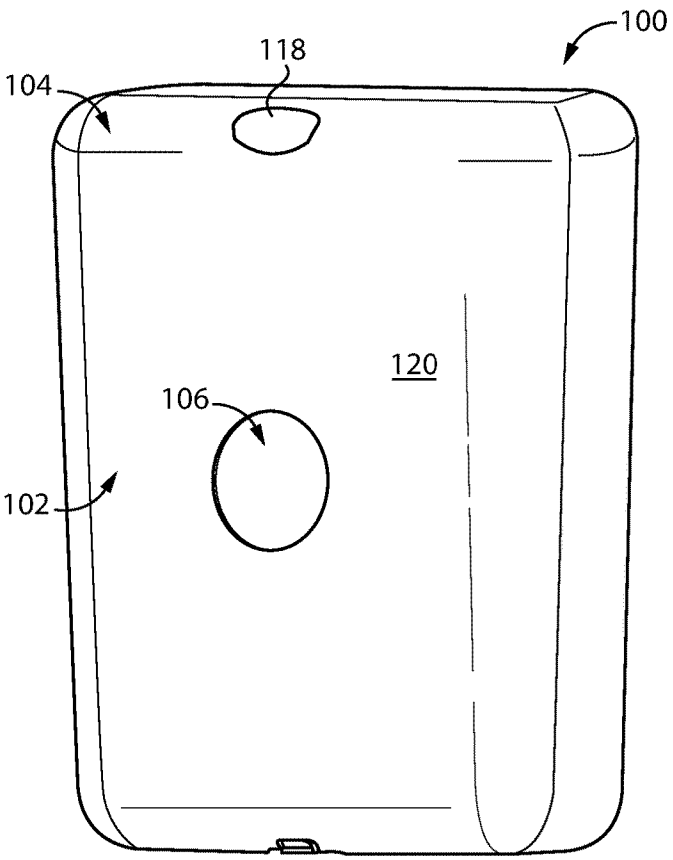
FIG. 2 is a front perspective view of a hands fee waste disposal unit having an aperture for dispensing a disposal bag.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

Figure 1:
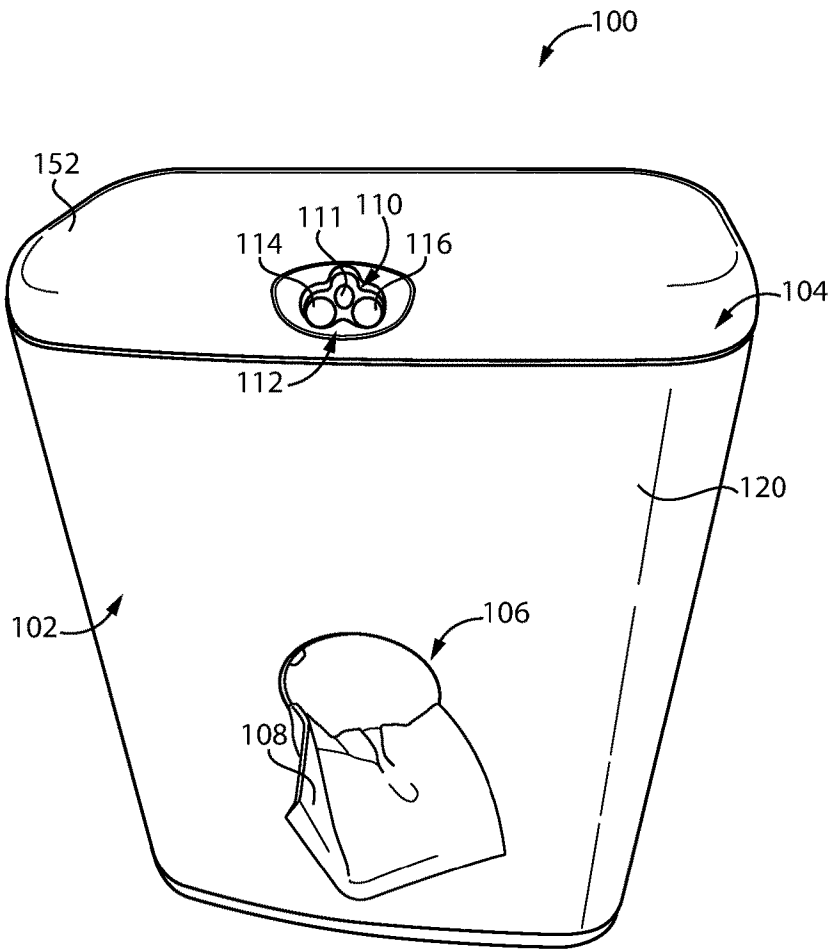
FIG. 1 is a front perspective view of a hands free waste disposal unit having a disposal bag.

FIG. 1 illustrates one embodiment of a hands free waste disposal unit 100 including a body 102 and a lid 104, configured to open and close the unit 100 for the disposal of waste products. The body 102 includes an aperture 106 (see also FIG. 2) configured to dispense one of a plurality of disposal bags 108 for use in the unit 100. In one embodiment, the disposal bags are located in a box that fits into a receptacle located within the body 102 adjacent to the aperture 106. Individual bags are withdrawn from the box, one at a time when needed, to replace a bag located in a cavity of the body 102.

The lid 104 supports a sensor housing 110 that includes an illumination device 111, such as a light emitting diode, and a sensor 112. See also FIG. 6 for the sensor housing 110. In one embodiment, the sensor 112 is an infrared sensor having an infrared transmitter 114 and an infrared receiver 116. See also FIG. 5. As seen in FIG. 2, the sensor housing 110 is covered by a sensor cover 118 configured to cover the illumination device 114 and the sensor 112. The sensor cover 118 is formed of a material capable of transmitting and/or receiving signals provided by the sensor 112. In other embodiments, the sensor 112 includes one or more of a capacitive sensor, a proximity sensor, an audio sensor, such as a microphone, a temperature sensor, and a code reader, such as an RFID reader.

As seen in FIGS. 1 and 2, the body 102 includes four sides and a bottom having an interior cavity of a predetermined size sufficient to accommodate the waste products. A front side 120 defines the aperture 106 Other sizes of the body 102 and the aperture 106 are contemplated. In other embodiments, the body 102 does not include an aperture and the box of disposal bags are located on a floor of the body 102.

Figure 3:
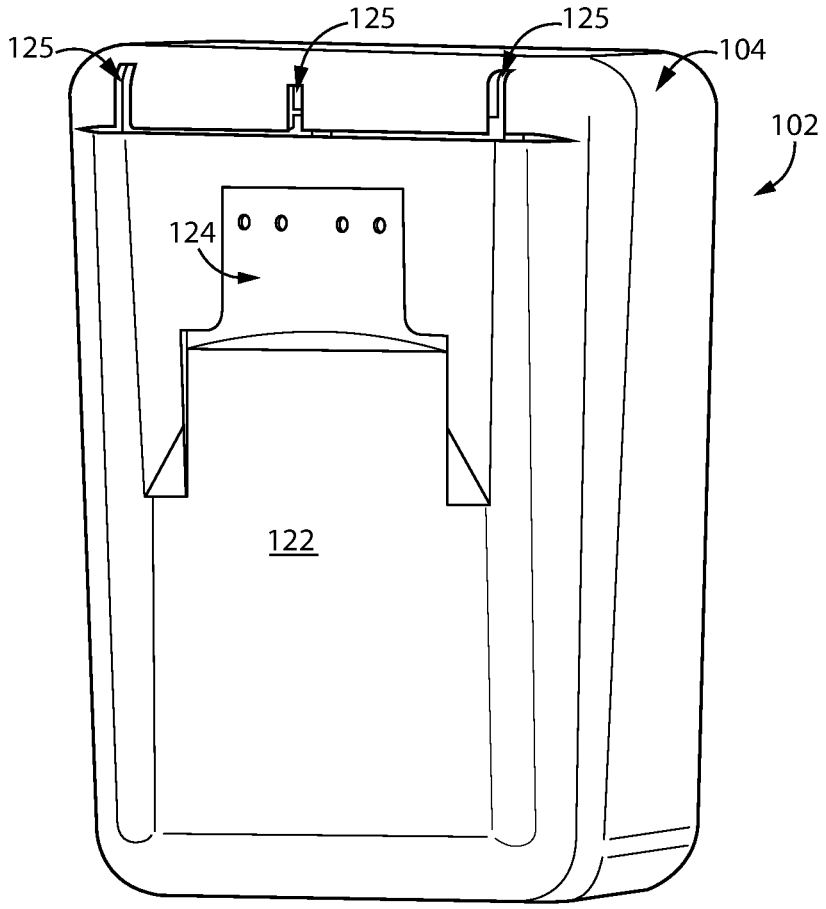
FIG. 3 is a rear perspective view of a hands fee waste disposal unit having a plate for hanging the unit on a wall.

As seen in FIG. 3, a back side 122 includes a plate 124 configured to attach the body 102 to a wall, for instance. In one embodiment, the plate 124 is a separate part having a rigid configuration sufficient to support the disposal unit 100 on the wall. The back side 122 of the body 102 includes a slot or aperture configured to accept the plate. The plate 124 is attached to a wall and the body 102 is hung on the plate. Other mechanisms of attaching the unit to a wall are also contemplated. As can also be seen in FIG. 3, the lid 104 a top cover 152 of the lid 104 includes three slots or apertures 125. See also FIG. 10.

Figure 4:
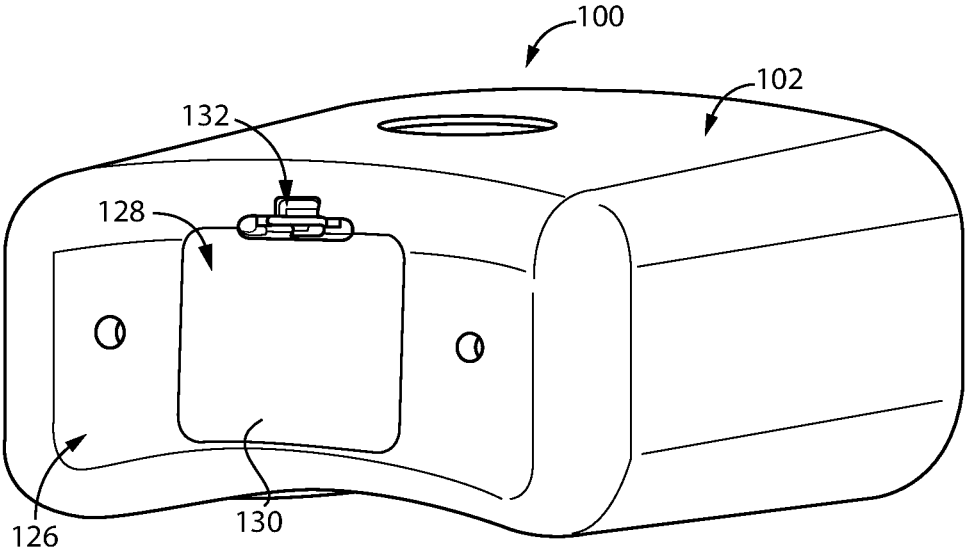
FIG. 4 is a bottom perspective view of a hands fee waste disposal unit having a battery compartment.

FIG. 4 illustrates a bottom portion 126 of the body 102 including a battery compartment 128 defining a recess in the body 102 and including a cover 130. The cover 130 opens and closes to enable user to remove and insert batteries used to operate the unit 100. In the illustrated embodiment, the body 102 includes a latch 132 configured to engage cover 130 to retain the cover 130 in a closed position.

Figure 5:
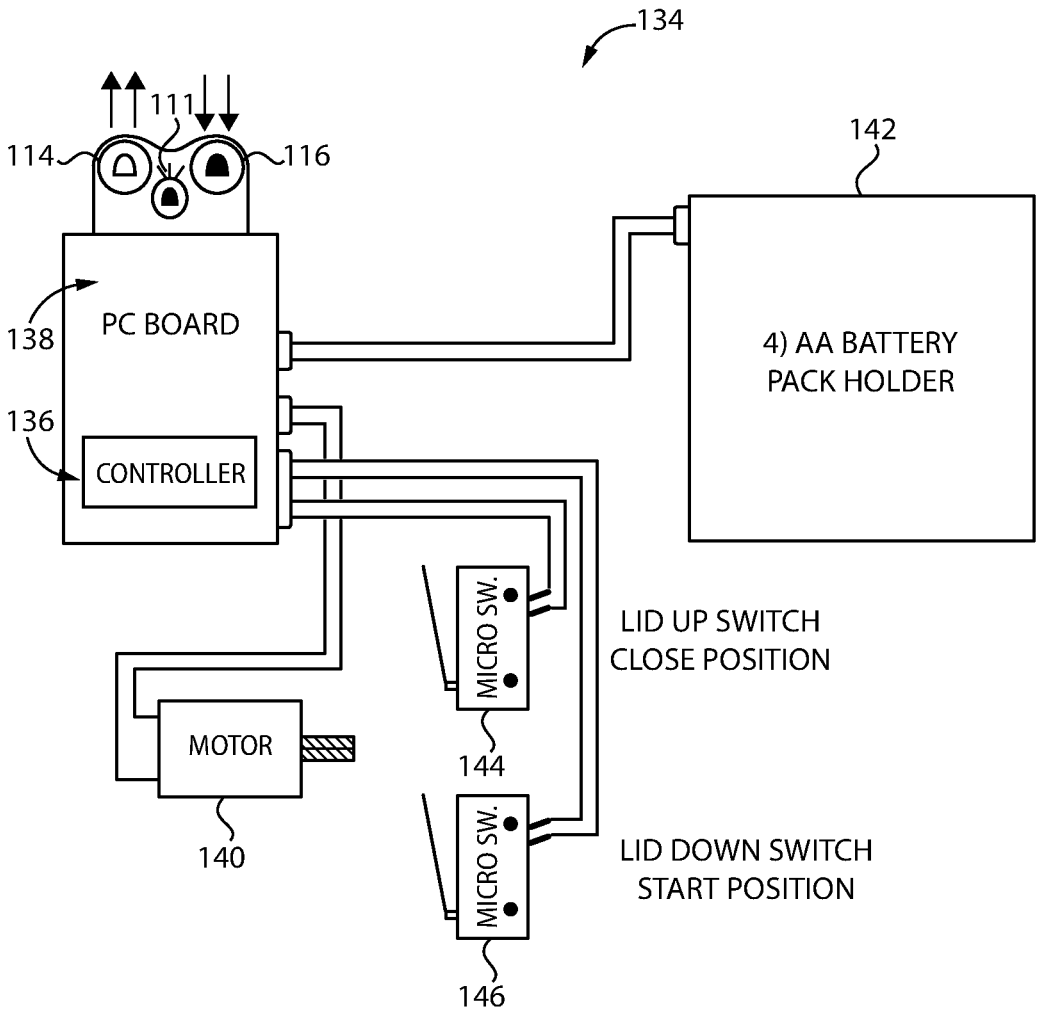
FIG. 5 is an electrical control diagram configured to move a lid of a hands free waste disposal unit from a closed position to an open position.

The disposal unit 100 includes an electrical control circuit 134 to open and close the lid 104, as is illustrated in FIG. 5. The control circuit 134 includes a controller 136 located on a printed circuit (PC) board 138 which is electrically and operatively connected to the infrared sensor 112. The controller 136 is configured to pulse the infrared transmitter 114 at a predetermined frequency to provide a transmitted signal, which is subsequently reflected by motion of a user in sufficient proximity to the infrared receiver 116. When the controller 136 determines that a reflected signal is received, the receiver 116 provides an open signal to the controller 136. Upon receipt of the open signal, the controller 136 transmits a motor signal to activates a motor 140, which is operatively and electrically coupled to the controller 136 through the PC board 138.

The control circuit 134 is powered by one or more disposable or rechargeable batteries 142 located in the battery compartment 128. The batteries 142 provide operating power for the illuminated device 111, the sensor 112, the controller 136, and the motor 140. Other mechanisms of providing power are contemplated including connecting the unit 100 to a building's power source. The control circuit 134 includes a first switch 144 and a second switch 146 each of which are electrically and operatively coupled to the controller 136 for opening and closing the lid as described herein. In one embodiment, the switches 144 and 146 are microswitches. Other types of switches are contemplated.

The control circuit 134 is located on a lid cover 150 which is fixedly connected to the top cover 152 of the lid 104. See also FIG. 10. The control circuit 134 is consequently located within the lid 104 and moves with the lid as the lid is opened and closed. Other locations of the control circuit 134 are contemplated. The lid cover 150 provides support for the sensor housing 110 including the illumination device 111, the transmitter 114 and the receiver 116. The housing 110 includes three apertures, one for each of the devices 111, 114, and 116, wherein the three devices are slight recessed in the housing 110. By recessing the transmitter 114 and the receiver 116, the transmitted signal from the transmitter 114 does not activate the receiver 116 so that the receiver 116 responds to reflected signals for opening the lid 104.

Figure 6:
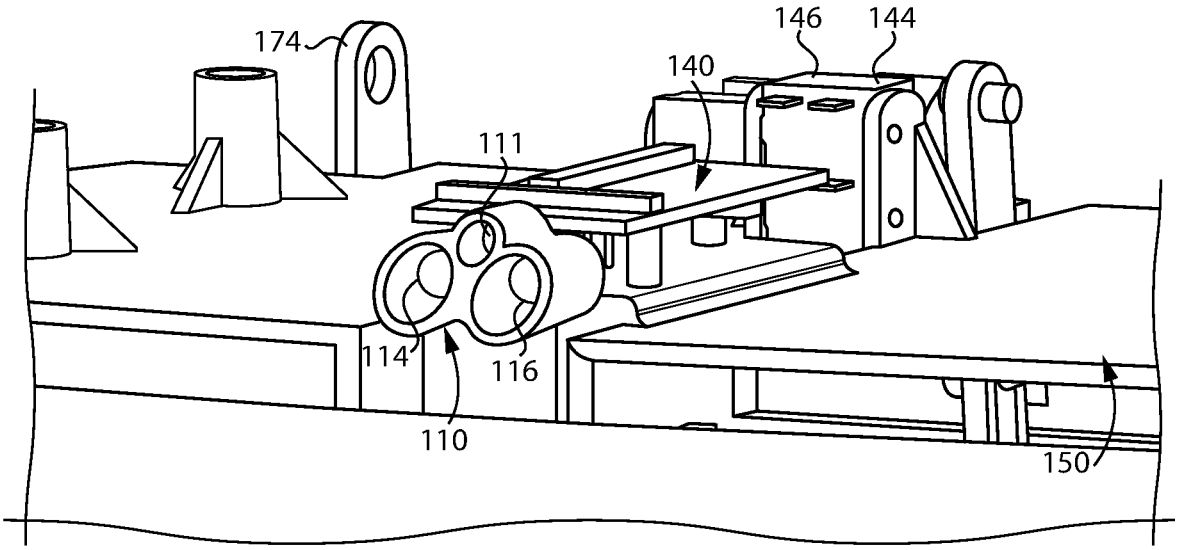
FIG. 6 is a front perspective view of a portion of a lid of a hands free waste disposal unit and an electrical control circuit.
Figure 7:
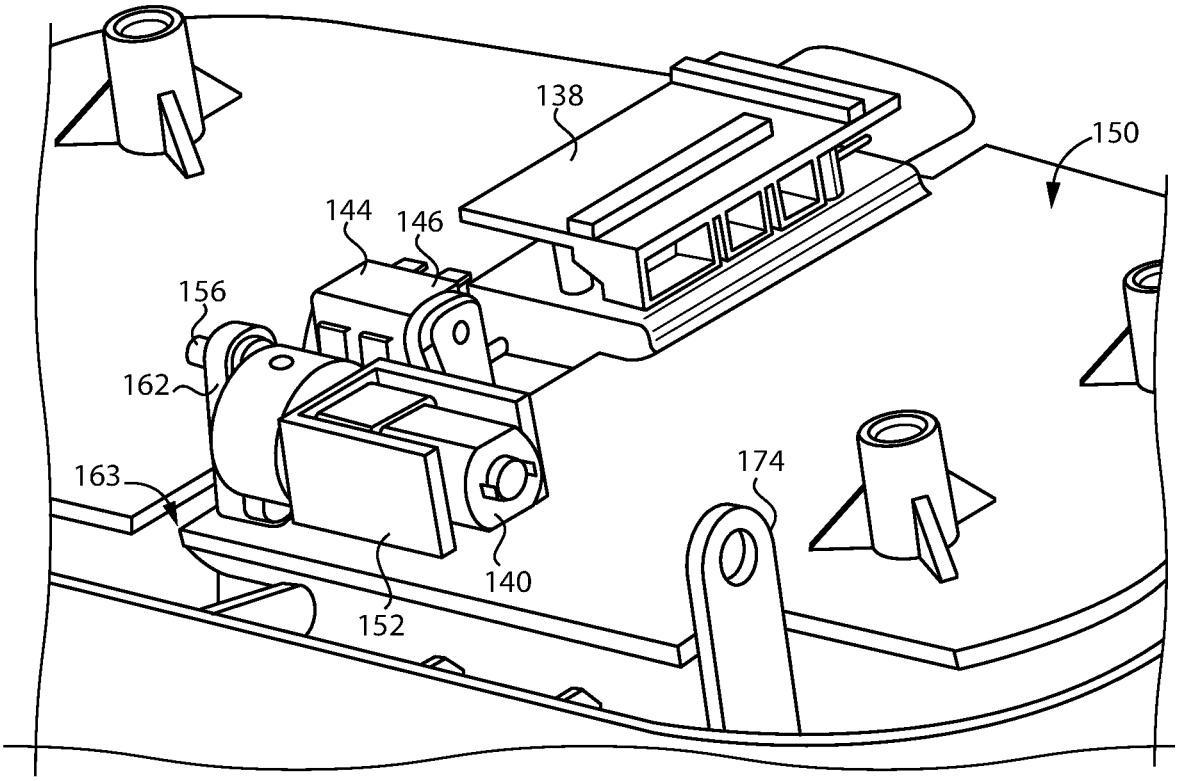
FIG. 7 is a rear perspective view of a portion of a lid of a hands free waste disposal unit and an electrical control circuit.

As seen in a front view of the lid cover 150 in FIG. 6 and a rear view of the lid cover 150 in FIG. 7, the motor 140 is fixedly supported in place by a motor support 153. Each of the first and second switches 144 and 146 and the PC board 138 are also fixedly connected to the lid cover 150. Electrical wires and/or cabling (not shown) connect each of the devices to the PC board 138 as illustrated in FIG. 5.

Figure 8:
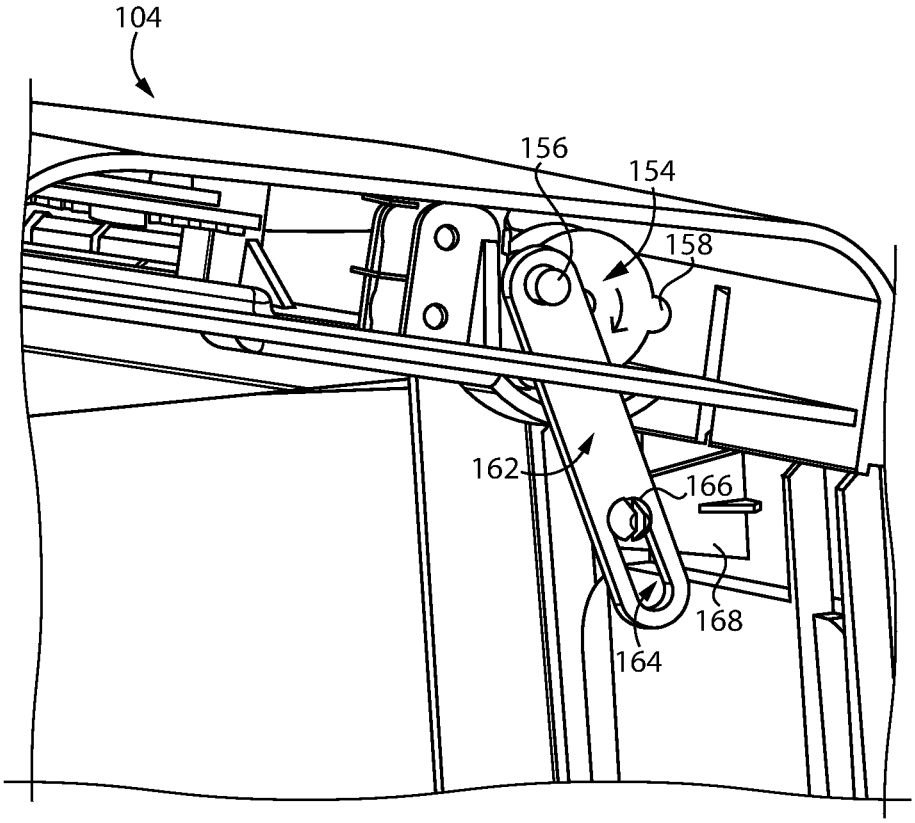
FIG. 8 is a sectional perspective view of a lid moving mechanism.

The motor 140 responds to command signals provided by the controller 136 to open the lid in response to sensor signals activated by a user. In FIG. 8, the shaft of the motor 140 is fixedly connected to a crank 154 which includes a pin 156, a first projection 158, and a second projection 160. See also FIG. 9. An arm 162 is rotatably coupled to the pin 156 and extends from the pin 156 toward an inside back portion of the body 102 through a slot 163. An end of the arm 162, opposite the end that engages the pin 156, includes a slot 164 which engages a pin 166 fixedly coupled to a bracket 168 extending from the inside back portion of the body 102. The pin 156 of the crank 154 is offset from the shaft of the motor 140.

When the controller 136 receives a signal from the sensor 112, the controller 136 transmits a signal to the motor 140 for the motor to start rotation of the motor shaft. At the same time, the controller transmits a signal to illuminate the illumination device 111 to indicate that the lid is being opened. The first projection 158 is appropriately located adjacent to a lever arm of the switch 144 which provides an indicator to the controller that the motor shaft has started rotation. As the motor shaft rotates in a clockwise direction as shown in FIG. 8, the arm 162 is driven toward the pin 166 which moves the lid from a closed position to an open position. Once the pin 156 reaches its bottommost position, the lid 104 is opened to its maximum position. Further rotation of the motor shaft moves the pin 156 in a further clockwise direction, such that the slot 164 moves along the pin 166 until a bottom portion of the slot contacts the pin 166. At this location, the lid 104 is opened and positioned for closing. After a six second delay, motor shaft is moved in an opposite or reverse direction and the second projection 160 moves in a counterclockwise direction until the projection 160 contacts the arm of the switch 146. At this location, the switch 146 provides an indication to the controller 136 that the lid is closed.

The controller 136, in response, stops movement of the motor until the sensor 112 is actuated once more by a user. At the same time, the controller 136 transmits a signal to turn off the illumination device 111 to indicate that the lid is closed. Other periods of a delay time between opening and closing of the lid are contemplated.

In another embodiment, the lid 104 remains open for a predetermined period of time in response to the controller 136 receiving a signal from the sensor 112 or until the sensor 112 is activated a second time. Once the lid 104 moves to the open position, the lid 104 remains open until the predetermined period of time has elapsed after which the lid closes automatically. In one embodiment, the period of time is one (1) minute. If, however, the sensor 112 is activated by a user (such as by a wave of the hand) before the predetermined period of time has elapsed, the lid moves to the closed position in response to the activation. This embodiment enables a user to replace a used disposal bag 108 with a new disposal bag 108 without the lid 104 closing before the bag has been replaced. If the user replaces the bag but does not need a full minute to make the replacement, the user, if desired, closes the lid before the time has elapsed.

Figure 9:
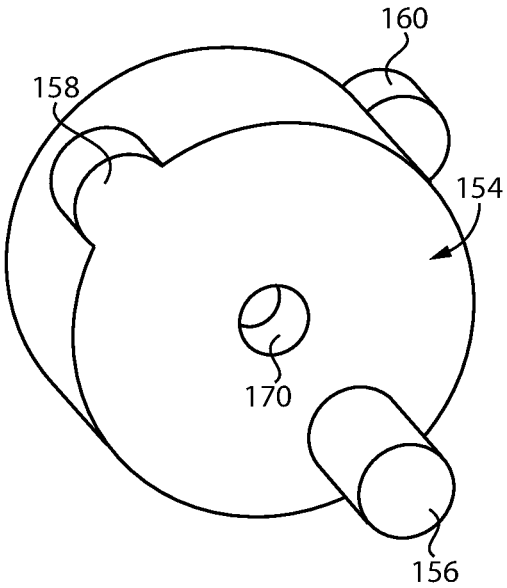
FIG. 9 is a perspective view of a crank of a lid moving mechanism.

As shown in FIG. 9, the crank 154 is configured as a disk wherein the projections 158 and 160 extend radially from a center aperture 170, through which the motor shaft extends. The projections 158 and 160 are offset from a centerline of the crank 154, such that each one contacts the correct arm of one of the microswitches 144 and 146. The pin 156 extends longitudinally from the crank 154 in the same direction as the motor shaft.

In one or more embodiments, the controller 136 includes a processor and a memory (not shown). The memory is configured to store program instructions and the processor is configured to execute the stored program instructions in response to transmitted signals received from the user sensor 112. The controller 136, in different embodiments, includes a computer, computer system, or other programmable devices. In other embodiments, the controller 136 includes one or more processors (e.g. microprocessors or programmable controller chips), and an associated memory, which can be internal to the processor of external to the processor. The memory can include random access memory (RAM) devices comprising the memory storage of the controller 136, as well as any other types of memory, e.g., cache memories, non-volatile or backup memories, programmable memories, or flash memories, and read-only memories. In addition, the memory, in different embodiments, includes a memory storage physically located elsewhere from the processing devices and any cache memory in a processing device, as well as any storage capacity used as a virtual memory, e.g., as stored on a mass storage device or another computer coupled to the controller. The mass storage device can include a cache or other dataspace which can include databases. Memory storage, in other embodiments, is located in the "cloud", where the memory is located at a distant location which provides the stored information wirelessly to the controller 136.

In one embodiment, the controller 136 is configured to control the amount of time that the lid is opened. For instance, once an open signal is received from the sensor 112, the controller 136 starts a timer that is set for a predetermined period of time. The timer counts until the timer reaches the predetermined period of time. Once the predetermined period of time is reached, the controller 136 transmits a close signal to the motor 140 at which time the motor shaft rotates to close the lid 104. In one embodiment, the period of time for the timer is set to six (6) seconds. Other periods of time, however, are contemplated. In other embodiments, the timer is a device external to the controller.

In one or more embodiments, the controller is configured to monitor the power provided by the power source 142. When the power is insufficient to provide proper opening and closing of the lid 104, the controller 136 transmits a signal to the illumination device 111 to repetitively turn the device 111 on and off.

Figure 10:
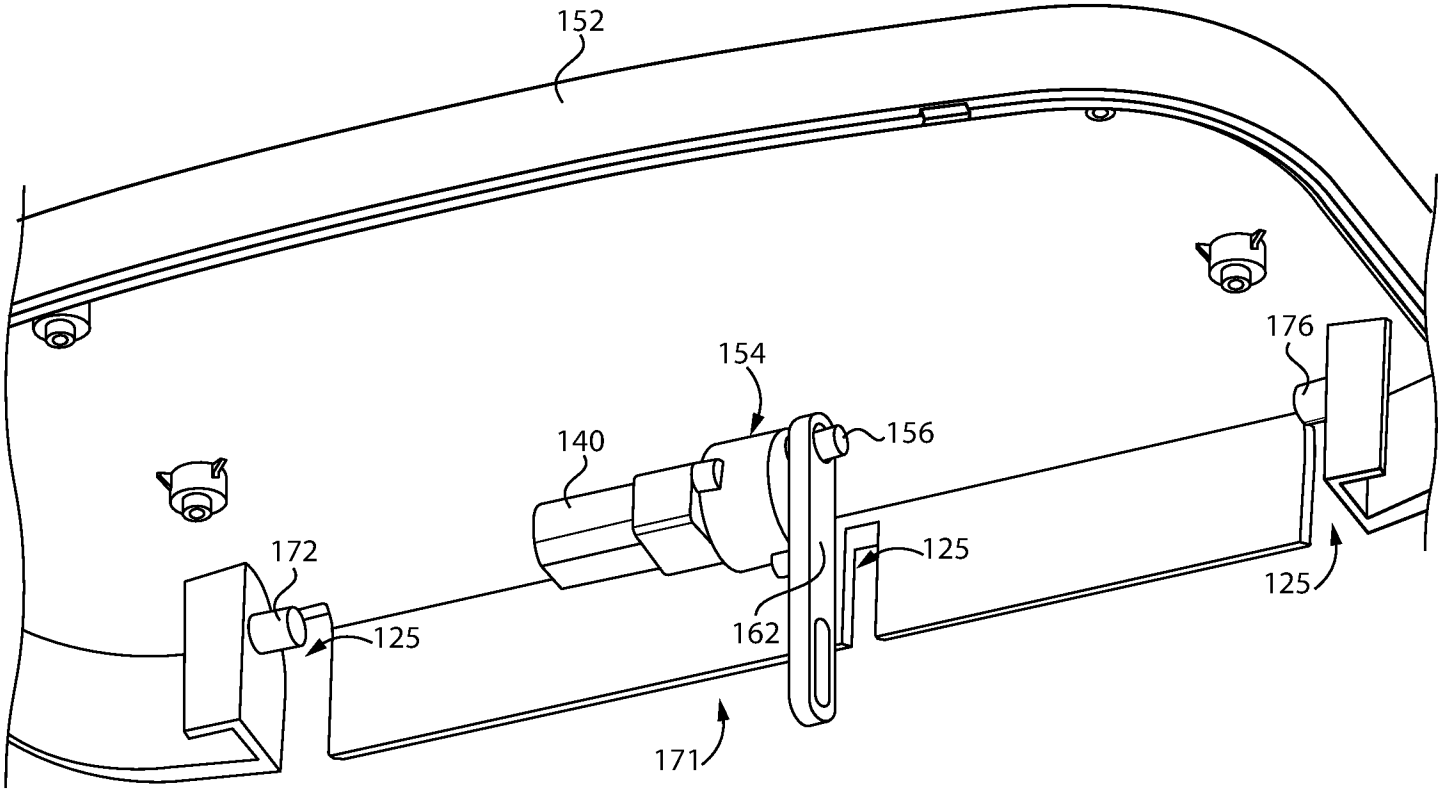
FIG. 10 is a bottom perspective view of a lid cover for a lid of a hands free waste disposal unit.

FIG. 10 illustrates an underneath perspective view of the top cover 152 including a portion 171 of the lid drive mechanism. The top cover 152 includes a first hinge pin 172 configured to engage a pin support 174 of FIG. 7. The top cover 152 includes a second hinge pin 176 configured to engage another pin support (not shown). The slots 125 at either end of the top cover 152 provide a passage for the pin supports 174 to move through the slots during rotation of the lid 104. The centrally located slot 125 provides a passage for the arm 162.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

What is claimed is:

1. A hands free waste disposal unit for receiving disposed waste product comprising:

a body defining a cavity configured to hold the disposed waste product;

a lid including a top portion and a bottom portion, the lid having a closed position and an open position, wherein the lid including both the top portion and the bottom portion is rotatably coupled to the body; and a control circuit located within the lid, wherein the control circuit includes a sensor and a motor each coupled to a controller, wherein the controller is configured to receive an open signal from the sensor and to transmit a motor signal to the motor to move the lid from the closed position to the open position, wherein the motor and the controller are both located between the top portion and the bottom portion.

2. The waste disposal unit of claim 1 wherein the controller is configured to execute program instructions stored in a memory to:

identify a period of time to move the lid from the open position to the closed position.

3. The waste disposal unit of claim 2 wherein the body includes a bracket located at an interior surface of the body and the motor is operatively connected to the bracket to move the lid between the closed position and the open position.

4. The waste disposal unit of claim 3 further comprising an arm and the motor includes a shaft, wherein the arm is operatively connected to the shaft and to the bracket, wherein rotation of the shaft moves the arm which moves the lid from the closed position to the open position.

5. The waste disposal unit of claim 4 further comprising a crank operatively connected to the shaft and the arm is operatively connected to the crank, wherein the crank rotates in response to rotation of the shaft to move the arm to open and to close the lid.

6. The waste disposal unit of claim 5 wherein the arm includes a first end and a second end wherein the first end is rotationally coupled to the crank at a pin of the crank, the pin being displaced from a centerline of the spindle.

7. The waste disposal unit of claim 6 wherein the arm includes a slot disposed at the second end, wherein the slot moves along a pin of the bracket.

8. A hands free waste disposal unit for receiving disposed waste product comprising;

a body defining a cavity configured to hold the disposed waste product;

a lid having a closed position and an open position, the lid rotatably coupled to the body;

a control circuit located within the lid, wherein the control circuit includes a sensor and a motor each coupled to a controller, wherein the controller is configured to receive an open signal from the sensor and to transmit a motor signal to the motor to move the lid from the closed position to the open position, wherein the controller is configured to execute program instructions stored in a memory to: identify a period of time to move the lid from the open position to the closed position, wherein the lid includes a top portion and a bottom portion, wherein the motor and the controller are located between the top portion and the bottom portion;

wherein the body includes a bracket located at an interior surface of the body and the motor is operatively connected to the bracket to move the lid between the closed position and the open position;

further comprising an arm and the motor includes a shaft, wherein the arm is operatively connected to the shaft and to the bracket, wherein rotation of the shaft moves the arm which moves the lid from the closed position to the open position;

a crank operatively connected to the shaft and the arm is operatively connected to the crank, wherein the crank rotates in response to rotation of the shaft to move the arm to open and to close the lid;

wherein the arm includes a first end and a second end wherein the first end is rotationally coupled to the crank at a pin of the crank, the pin being displaced from a centerline of the spindle;

wherein the arm includes a slot disposed at the second end, wherein the slot moves along a pin of the bracket; and a first switch having a first lever arm, wherein the crank contacts the first lever arm during rotation of the crank to cause the controller to open or to close the lid.

9. The waste disposal unit of claim 8 wherein the crank includes a first projection and contact of the first projection with the first lever arm causes the controller to open the lid.

10. The waste disposal unit of claim 9 further comprising a second switch having a second lever arm and the crank includes a second projection, wherein contact of the second projection with the second lever arm causes the controller to close the lid.

11. A hands free waste disposal unit for receiving disposed waste product comprising:

a body configured to hold the disposed waste product;

a lid including a top portion and a bottom portion, the lid defining a cavity between the top portion and the bottom portion and defining a slot in the bottom portion, wherein the lid is rotatably coupled to the body and moves from a closed position to an open position;

a sensor configured to sense physical movement provided by a user;

a motor located within the cavity of the lid and operatively connected to the sensor, the motor including a shaft that rotates in response to the sensed physical movement, wherein the motor moves the lid from a closed position to an open position; and an arm operatively connected to the shaft and to the body, wherein the arm extends through the bottom portion and moves within the slot when the lid moves from the closed position to the open position.

12. The hands free waste disposal unit of claim 11 wherein the shaft is located within the cavity of the lid and the shaft moves with the lid when the lid moves from the closed position to the open position.

13. The hands free waste disposal unit of claim 12 further comprising a controller operatively connected to the sensor and to the motor, wherein the controller is configured to receive an open signal from the sensor and to transmit a motor signal to the motor to move the lid from the closed position to the open position.

14. A method of operating a disposal unit having a control circuit comprising:

sensing with a sensor a first physical movement provided by a user;

moving the lid of the disposal unit from a closed position to an open position in response to the sensed first physical movement;

sensing with the sensor a second physical movement provided by the user, wherein the second physical movement follows the first physical movement while the lid is in the open position; and moving the lid of the disposal unit from the open position to the closed position with a motor in response to the sensed second physical movement, wherein the control circuit includes a controller located within the lid and which transmit signals to the motor to move the lid, wherein the controller moves with the lid as the lid moves from the closed position to the open position and from the open position to the closed position.

15. The method of claim 14 further comprising moving the lid of the disposal unit from the open position to the closed position in response to the second physical movement before a predetermined period of time has elapsed or moving the lid of the disposal unit from the open position to the closed position after a predetermined period of time has elapsed if the sensor does not sense the second physical movement before the predetermined period of time has elapsed.

16. The method of claim 15 wherein the first moving step includes moving the lid of the disposal unit from the closed position to the open position with a crank operatively connected to the motor that is operatively connected to the controller.

17. The method of claim 16 wherein the first moving step includes moving the lid of the disposal unit from the closed position to the open position in response to a first projection of the crank contacting a first lever arm of a first switch.

18. The method of claim 17 wherein the second moving step includes moving the lid of the disposal unit from the closed position to the open position with a second projection of the crank, wherein the second projection contacts a second lever arm of a second switch.

* * * * *